United States Patent [19]

Begg

[11] Patent Number: 4,972,523

[45] Date of Patent: Nov. 27, 1990

[54] NECKTIE RETAINER

[76] Inventor: Robert J. Begg, Apt. 2310, 900 Lake Shore Dr., Chicago, Ill. 60611

[21] Appl. No.: 350,787

[22] Filed: May 12, 1989

[51] Int. Cl.[5] ..... A41D 25/04

[52] U.S. Cl. ..... 2/145; 2/137; 2/144; 24/40 CF; 24/49 M; 24/49 CC; 24/49 TS

[58] Field of Search ..... 2/137, 145; 29/49 CF, 29/49 M, 54, 56, 64

[56] References Cited

U.S. PATENT DOCUMENTS

| | | | |
|---|---|---|---|
| 2,588,576 | 3/1952 | Roop et al. | 2/145 |
| 2,652,569 | 9/1953 | Confino | 2/145 |
| 2,990,551 | 7/1961 | Schreter et al. | 24/49 TS |
| 3,405,408 | 10/1968 | Baker | 2/145 |
| 3,453,696 | 7/1969 | Mates | 24/49 CC |
| 3,455,408 | 10/1968 | Baker | 2/145 |
| 3,487,471 | 1/1970 | Hagen | 2/145 |
| 4,827,576 | 5/1989 | Prince, Jr. | 24/49 CF |
| 4,835,821 | 6/1989 | Durante | 24/49 CF |

FOREIGN PATENT DOCUMENTS

| | | | |
|---|---|---|---|
| 158526 | 8/1954 | Australia | 2/145 |
| 1177649 | 4/1959 | France | 2/145 |
| 291166 | 1/1950 | Switzerland | 2/145 |

*Primary Examiner*—Werner H. Schroeder
*Assistant Examiner*—Jeanette E. Chapman
*Attorney, Agent, or Firm*—Frederick K. Lacher

[57] ABSTRACT

A retainer for containing the free hanging terminal ends of a necktie has two primary portions, a tailend retaining band carried by a button on the wearer's shirt and a longitudinal strip portion carried by the backside surface of the display end of the necktie and the band and strip portion having complimentary hook-and-loop fabric material which may be fastened temporarily together to secure the terminal ends. The tailend of the necktie is passed vertically through an opening in the band and is slidably contained thereby while the display end is secured by the hook-and-loop fabric fastening.

6 Claims, 1 Drawing Sheet

NECKTIE RETAINER

BACKGROUND OF THE INVENTION

This invention generally pertains to necktie retainers and more particularly to a two-portion necktie retainer utilizing hook-and-loop type material wherein one of the portions is adhered to the backside of the necktie fabric forming the display end thereof while the other portion is mounted on a wearer's shirt button, the two portions coacting by way of the hook-and-loop material to secure the terminal ends of the necktie in an orderly way to the front of the wearer's shirt.

Numerous and various jewelry type pins, tacks, and bars are available in the marketplace to solve the problem of preventing the terminal end of a necktie from getting disoriented and appearing messy when such necktie is worn. These type devices are not favored, however, when the purchase price of the necktie far exceeds the price of these type devices which may cause damage to the fabric material comprising the necktie. For example, some of the more exotic fabrics are damaged by penetrating the material with pins, tacks and the like as the holes made when the pins are pushed through the fabric remain even after the pins are removed. Further, these jewelry type necktie retainers may have rough parts and/or burrs on them and these will catch the fine threads of the necktie fabric causing damage which may not be repairable. In this respect, others have attempted to solve this problem by proposing various necktie retaining configurations which do not use pins, tacks and/or bars to hold the terminal ends of the necktie in place. Exemplary of these are proposals found in patents to Roop et al (No. 2,588,576) and Confino (No. 2,652,569) which utilize various configurations of fabric adhered to the backside surface of the necktie fabric and which have one or more buttonholes in them to be secured to a button on the shirt of a wearer. Other proposals are found in patents to Baker (No. 3,405,408) and Hagen (No. 3,487,471) which use various configurations of hook-and-loop type materials to hold the terminal ends of the necktie in place. All of these prior configurations of necktie retainers suffer from the same defect, and that is, it is assumed that all button closures on all shirts have the same button spacing. Thus, when these prior art retainers are mounted in position on the backside surface of a necktie, the buttonhole spacing is set and cannot be altered. In this respect, it may only be by chance that the necktie retainer buttonholes mate with a button on the wearer's shirt. Another problem prior art configurations is that they comprise too many individual parts and/or pieces, multiples of which must be mounted on both terminal ends of the necktie while other parts are large, i.e., they cover a large area of the backside surface of the necktie fabric adding bulk to the product.

It is, therefore, in accordance with one aspect of the present invention an object to provide a necktie retainer which comprises but two separate portions which cooperate to retain the terminal ends of a necktie and only one of the retainer portions is applied to the necktie.

It is in accordance with another aspect of the invention an object to provide a configuration for a necktie retainer which does not adversely affect the fabric material comprising the necktie and which may be applied to the necktie at the time of its manufacture or alternatively at a later time upon being purchased by the consumer.

It is in accordance with still another aspect of the invention an object to provide a configuration for a necktie retainer which gives the necktie wearer a wide latitude in the manner of tying the necktie while still providing a retainer which operates to hold the terminal ends thereof in a favorable position or orientation with respect to the front closure of the wearer's shirt.

It is in accordance with another aspect of the invention an object to provide a necktie retainer which is easily and economically made and is suitable for use with any width and/or length necktie while also being usable with any configuration of a button-down shirt closure.

SUMMARY OF THE INVENTION

The above-mentioned aspects and advantages of the invention are accomplished in a necktie retainer usable in conjunction with a necktie having a tailend and display end which hang freely with reference to a wearer's buttoned shirt closure, the retainer comprising a tailend retaining band including a face strip ply of a hook-and-loop type fabric material, the ends of which are affixed to a backing strip ply of fabric material for wrapping around said tailend, the backing strip having attaching means for attachment to the shirt of the wearer, and a display end retaining portion including a length of hook-and-loop fabric material secured to the backside surface of the necktie longitudinally along the centerline of the display end, the tailend retaining band and the display end retaining portion having complimentary hook-and-loop fabric material such that the tailend may be temporarily fastened to the display end when the necktie is worn and the tailend is passed vertically through an opening in the tailend retaining band.

BRIEF DESCRIPTION OF THE DRAWINGS

The invention will be better understood and appreciated from a consideration of the detailed description that follows when viewed in conjunction with the accompanying drawings in the several figures in which like parts bear like reference numerals and in which.

DETAILED DESCRIPTION OF THE INVENTION

Figure 1:
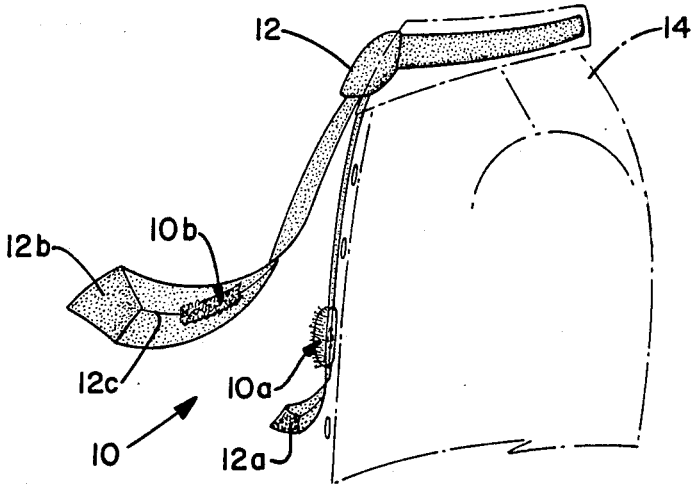
FIG. 1 is a side view of a necktie as it is worn with a dress shirt and retained by the present invention, the shirt being shown in ghost lines for the purpose of the environment only.

Referring to the drawings, FIG. 1 illustrates a necktie retainer in accordance with the present invention and generally indicated by reference numeral 10 as it may be applied to the securing of a necktie 12 to the front of a wearer's shirt 14. Conventionally, when such necktie 12 is worn, a tailend 12*a* hangs freely as does a larger display end 12*b*, the tailend 12*a* being positioned behind the display end 12*b* and adjacent the wearer's shirt 14. The necktie retainer 10 comprises two basic elements, a necktie tailend retaining band 10*a* and a necktie display end retaining portion 10*b*. Obviously, it should be clear from the drawings that the retaining band 10*a* and retaining portion 10*b* coact in a particular manner to effect securing of the necktie terminal ends 12*a*,12*b* in the desired position and/or orientation to the front of the shirt 14.

Figure 2:
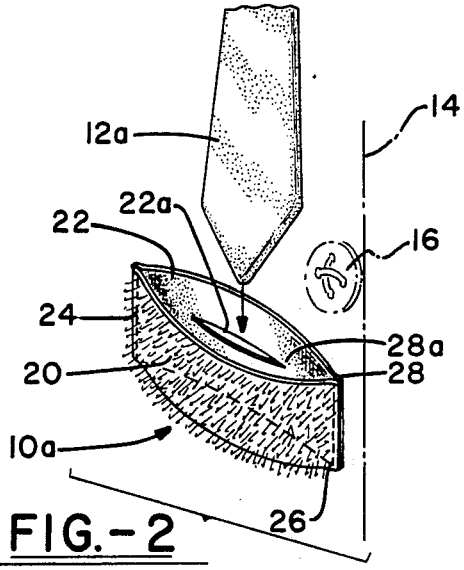
FIG. 2 is an enlarged perspective view of one element comprising the tailend retaining band of the invention illustrating its attachment to the wearer's shirt and the relationship with a tailend portion of the necktie to be secured.

The necktie tailend retaining band 10*a* of this embodiment is more clearly illustrated in FIG. 2 of the drawings and it comprises a face strip 20 of a hook-and-loop type material, such as for example Velcro TM material, which may be sewn or otherwise secured along lateral edges 24 and 26 to a backing strip 22. The backing strip 22 comprises a conventional fabric material and its orientation with the face strip 20 is such as to form a closed loop 28 having an opening 28*a* of sufficient dimension as to wrap around the tailend 12*a* of a conventional necktie 12. It is understood that the band 10*a* may be fabricated of other materials and in other configurations for wrapping around the tailend 12*a* of the necktie 12. Attachment means for attaching the band 10*a* to the wearer's shirt 14 may include a buttonhole 22*a* in the backing strip 22 for receiving one of the plurality of buttons found on a wearer's dress shirt 14. As illustrated in FIG. 2 of the drawings, a shirt button 16 may be pushed through the buttonhole 22*a* after which the necktie retaining band 10*a* is rotated to a substantially horizontal orientation such that the opening 28*a* in the loop 28 may receive the tailend 12*a* of the necktie 12 in its vertical position. In this respect, it is an important consideration in the fabrication of the tailend retaining band 10*a* that its length is sufficient such that when forming the loop 28 the opening 28*a* is large enough so that the wearer may easily mount it to a shirt button 16. For example, it must not be difficult for a person having short and stubby fingers to manipulate the retaining band 10*a* onto the shirt button 16. In this respect it has been determined that the retaining band 10*a* should have a length within the range of one to 1.75 inches (2.54 to 1.9 cm) and its width should preferably be within the range of 0.375 to 0.625 inches (0.95 to 1.59 cm). A tailend retaining band 10*a* within these dimensions will provide an opening 28*a* of sufficient size for receiving most widths of the necktie tailend 12*a* while also allowing for easy mounting onto a shirt button 16 by even the most inept of necktie wearers. The attachment of the tailend retaining band 10*a* to the shirt 14 may also be made by other means such as a connection to a buttonhole of the shirt.

Figure 3:
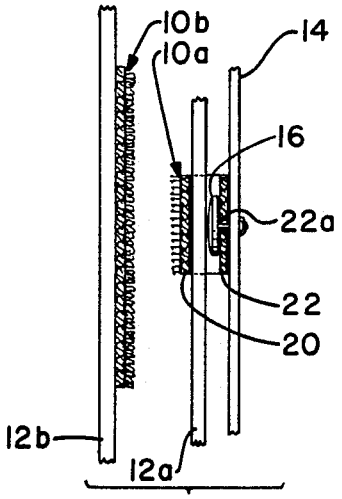
FIG. 3 is a side elevational view, partially in cross section, of the necktie retainer as it may be used in relationship to a shirt button and the two terminal ends of a necktie.

Referring now to FIG. 3, the drawing illustrates a vertical orientation of the necktie retaining band 10*a* and display end retaining portion 10*b*, the band 10*a* being in cross section so as to expose the mounting on the shirt button 16. As clearly illustrated in this figure and also in FIG. 1, the display end retaining portion 10*b* is adhered to the necktie display end 12*b* on the underside thereof and along a vertical seam at a centerline 12*c* and because of the horizontal orientation of the tailend retaining band 10*a*, the wearer has substantial latitude in how long or short he wishes to tie the necktie 12. As a matter of fact, the wearer has two options available in this respect; he may either move the tailend retaining band 10*a* up or down to a new button position and/or he may tie the necktie longer or shorter such that the tailend retaining band 10*a* and the display end retaining portion 10*b* are matched or mated together.

It will, of course, be recognized by those knowledgeable of the hook-and-loop type materials that the face strip 20 and display end retaining portion 10*b* are complimentary and may comprise one or the other of the hook or loop material. If, for example, hook material comprises the face strip 20 of the tailend retaining band 10*a*, then the display end retaining portion 10*b* will comprise loop material or vice versa. The invention, therefore, is not considered limited by the type of hook or loop material which is applied to the necktie retainer 10 of the invention.

Figure 4:
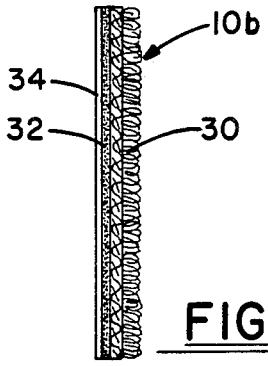
FIG. 4 is an enlarged elevational view of the display end retaining portion of the necktie retainer.
Figure 5:
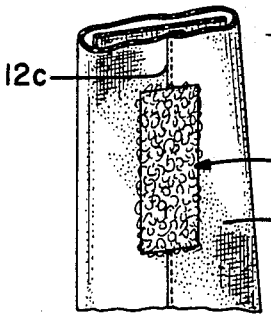
FIG. 5 is a backside view of the display terminal end of the necktie illustrating the display end retaining portion as part and parcel of the necktie fabric.

Referring now to FIG. 4 of the drawings, an elevational view of the necktie display retaining portion 10*b* is illustrated as it may comprise loop material 30. The loop material 30 may be adhered to the backside of the display end 12*b* of the necktie 12 by various methods including sewing it to the fabric comprising the necktie. Preferably, and because the necktie 12 maY be made from one of the more exotic fabrics which may be damaged by sewing needle punctures, the display end retaining portion 10*b* may be adhered to the necktie fabric by means of an appropriate adhesive material indicated at 32 in the drawing. Prior to its being applied to the necktie 12, the adhesive 32 may be protected by a release ply 34 in a conventional manner of such type materials. It is anticipated that the display end retaining portion 10*b* will have a longitudinal length of at least 3 inches (7.62 cm) so as to always match up and mate with the tail end retaining band 10*a* which is mounted to a shirt button 16. The width of the display end retaining portion 10*b* will preferably be within the range of 0.31 to 0.44 inches (0.79 to 1.11 cm) so as to provide a secure but temporary fastening relationship to the tailend retaining band 10*a* by way of the hook-and-loop fabric material carried by the band and the display end retaining portion.

From the foregoing, it will be appreciated that a necktie manufacturer may apply the display end retaining portion 10*b* to the necktie fabric at the time of its manufacture and enclose the tailend retaining band 10*a* with the necktie so as to be sold to the consumer at the time of purchase. Alternatively, the necktie retainer 10 of this invention may be packaged and sold separately from the necktie 12. In this circumstance, the purchaser merely peels off the release ply 34 and applies the display end retaining portion 10*b* to the backside of the display end 12*b* of necktie 12 while the tailend retaining band 10*a* is carried on the necktie display end retaining portion when the necktie retainer 10 is packaged and is then later removed for mounting on a shirt button 16.

It is further anticipated that the display end retaining portion 10*b* may be inserted in the fabric comprising the necktie 12 at the time of its manufacture. For example, the necktie seam at the centerline 12*c* is conventionally a sewn seam and a backing fabric of some heavier weight is carried within the folded configuration of the necktie 12 to give it a more pleasing shape when worn. In this respect, the hook or loop fabric which comprises the display end retaining portion 10*b* may be sewn in and become part and parcel of the necktie fabric structure. This will make it an integral part of the necktie 12 and not add any additional weight and/or thickness to the necktie.

While certain representative embodiments and details have been shown for the purpose of illustrating the invention, it will be apparent to those skilled in this art that various changes and modifications may be made therein without departing from the spirit it or scope of the invention. The invention therefore is only limited by the scope of the appended claims.

I claim:

1. A retainer usable in conjunction with a necktie having a tailend and a display end which hang freely with reference to a wearer's buttoned shirt closure, said retainer comprising in combination:

a tailend retaining band including a face strip ply of a hook-and-loop type fabric material the ends of which are affixed to a backing strip ply of fabric material to form a tubular band to encircle said tailend, said backing strip ply having a single buttonhole therethrough for attachment to a shirt of the wearer at a shirt button position; and a display end retaining portion including a length of hook-and-loop fabric material secured to a backside surface of said display end of said necktie longitudinally along a centerline of said display end;

said tailend retaining band and said display end retaining portion having complimentary hook-and-loop fabric matêrial such that said tailend retaining band is releasably fastened to said display end when said necktie is worn and said tailend is passed vertically through said tubular band and is freely movable through the band.

2. The retainer as set forth in claim 1 wherein the length of said display retaining portion is at least 3 inches (7.62 cm).

3. The retainer as set forth in claim 1 wherein said face strip ply of said tailend retaining band comprises hook fabric material and said display end retaining portion comprises loop fabric material.

4. The retainer as set forth in claim 1 wherein said display end retaining portion is secured to the backside surface of said necktie via an adhesive material.

5. The retainer as set forth in claim 1 wherein said display end retaining portion comprises hook-and-loop fabric material which is part and parcel of the fabric comprising said necktie.

6. The retainer as set forth in claim 1 wherein said display end retaining portion comprises hook-and-loop fabric material which is sewn in at the longitudinal seam at the backside of said necktie.

* * * * *